US006458211B1

(12) United States Patent
Wefers et al.

(10) Patent No.: US 6,458,211 B1
(45) Date of Patent: Oct. 1, 2002

(54) DEVICE AND METHOD FOR APPLYING A MEDIUM TO A SUBSTRATE, SYSTEM HAVING A PLURALITY OF SUCH DEVICES, AND USE OF SUCH DEVICE, METHOD AND SYSTEM

(75) Inventors: Lothar Wefers, Rosenheim (DE); Josef Juffinger, Thiersee (AT)

(73) Assignee: Stork Textile Printing Group B.V., Boxmeer (NL)

( * ) Notice: Subject to any disclaimer, the term of this patent is extended or adjusted under 35 U.S.C. 154(b) by 0 days.

(21) Appl. No.: 09/637,580

(22) Filed: Aug. 14, 2000

Related U.S. Application Data

(63) Continuation of application No. PCT/NL99/00074, filed on Feb. 12, 1999.

(30) Foreign Application Priority Data

Feb. 13, 1998 (DE) ..... 198 06 040

(51) Int. Cl.[7] ..... B05C 5/02

(52) U.S. Cl. ..... 118/669; 118/301; 118/310; 118/315; 101/119; 101/120; 101/123; 347/21; 347/43

(58) Field of Search ..... 118/301, 315, 118/406, 669, 310; 101/119, 120, 123; 347/21, 43; 427/272, 282

(56) References Cited

U.S. PATENT DOCUMENTS

| | | | | |
|---|---|---|---|---|
| 4,188,882 A | | 2/1980 | Jeschke et al. | |
| 4,436,032 A | | 3/1984 | Van Ouwerkerk | |
| 5,316,582 A | | 5/1994 | Dubel | |
| 5,584,932 A | * | 12/1996 | Clark et al. | 118/669 |
| 5,713,275 A | * | 2/1998 | Imai | 101/119 |
| 5,877,788 A | * | 3/1999 | Haan et al. | 347/28 |

FOREIGN PATENT DOCUMENTS

| | | |
|---|---|---|
| DE | 31 46828 A1 | 6/1983 |
| DE | 40 01 452 A1 | 7/1991 |
| DE | 42 28 177 A1 | 3/1993 |
| EP | 0 836 939 | 4/1998 |
| JP | 51238465 | 10/1986 |
| JP | 63194865 | 8/1988 |

* cited by examiner

*Primary Examiner*—Laura Edwards
(74) *Attorney, Agent, or Firm*—Oblon, Spivak, McClelland, Maier & Neustadt, P.C.

(57) ABSTRACT

The invention relates to a device and to a method for applying a medium in the form of liquid, powder or paste to a substrate, having a container for the medium and a transport device which takes the medium from the container and discretely distributes it. In a propelling device the medium is selectively transferred from the transport device to the substrate with a propellant which is separate from the medium, or in the propelling device the medium is selectively removed from the transport device, and the remaining medium is transferred from the transport device to the substrate.

46 Claims, 8 Drawing Sheets

DEVICE AND METHOD FOR APPLYING A MEDIUM TO A SUBSTRATE, SYSTEM HAVING A PLURALITY OF SUCH DEVICES, AND USE OF SUCH DEVICE, METHOD AND SYSTEM

CROSS-REFERENCE TO RELATED APPLICATIONS

This is a continuation application of PCT/NL99/00074 filed Feb. 12, 1999.

FIELD OF THE INVENTION

The present invention relates to a device and to a method for applying a medium in liquid, powder or paste form to a substrate, to a system having a plurality of such devices, as well as to a use of such device, method and system.

BACKGROUND OF THE INVENTION

The substrate in question is preferably a textile substrate, although large area substrates may also quite generally be used, for example a substrate made of foil, nonwoven fabric, metal, carpet, plastic, paper, wallpaper, wood, glass, porcelain, ceramic or a similar material. The substrate may also be a printing support, for example a printing plate or a printing roll, to which it is necessary to apply printing ink as a medium prior to printing on a substrate made of paper, wallpaper etc. The advantage is that the medium can be applied at specific points on the printing support. With the medium a pattern is to be applied to such a substrate with the sharpest possible contours and a high resolution.

Corresponding to the large number of different substrates indicated above, many methods and devices for patterning surfaces of such substrates are also known. If they are to function with a printing speed which is high enough for mass production, these methods and devices basically require stencils which are per se expensive to produce. An example which may be mentioned in relation to this is that of the textile printing industry: for the screen printing preferably employed in this case, millions of printing stencils are made year after year just for rotary and flatbed printing. A large number of gravure cylinders are also produced for printing on films.

For rotary screen printing, a distinction is essentially made between two ways of producing the stencils: these are directly patterned DEP stencils (DEP=Direct Electrolytic Patterning) and resined stencils. The DEP stencils have the pattern electrolytically applied directly to them and can thus be used without further etching. With DEP stencils, the pattern and the colour separation are therefore already incorporated into the relevant dies.

Conversely, for the production of resin stencils, cylindrical screens are firstly produced electrolytically in a relatively complicated way. Various etching resists are then applied, according to the etching technique which is being used. All the openings existing in the stencils are closed with the etching resist during this. The desired printing pattern is then created by controlled release of openings for the respective colour separated beforehand from the model. This procedure can be carried out either using photographic development and wet chemical washing of the resist, or by direct digital transfer of the information using a laser device which "burns off" the etching resist using a laser beam.

Resin stencils have the advantage over DEP stencils that, by removing and re-applying the resist, they can be reused many times for different designs, whereas the DEP stencils can be used only for one design.

In short, the production of printing stencils, whether rolls or plates for typographic or gravure printing on paper and film, or screen stencils for rotary printing or flatbed printing on textile or carpet, is elaborate. The same is also true as regards the resin stencils which can be used repeatedly, since with these, for repeated use, the resist firstly needs to be removed, after which resist is again applied, dried etc. and this is followed by etching.

The production of such stencils finally only leads to economically viable products, for example printed textile, if the stencils are produced in large numbers and can be employed over an extended period of time for printing on large numbers of articles.

Now, especially in textile printing the problem arises that the time for which printing patterns are regarded as fashionable is becoming ever shorter, and at the same time the variety of patterns is increasing continually. Always producing new stencils therefore leads, every time fashion changes, to new rises in costs for every shorter "yardages". This means that, especially in printing businesses in Europe and the USA, there are commonly large stocks of out-of-date stencils, the number of which may amount to several tens of thousands of stencils.

It should also be pointed out that stencil production as a whole, as well as stencil recycling, are very environmentally unfriendly and involve a large consumption of energy.

In view of this situation, consideration has already been given, for printing on textiles, to abandon the screen printing method and, for example, employ a digital inkjet printing method, successfully used in the paper industry, in order to transfer a pattern to textiles. In a method described in U.S. Pat. No. 4,324,117, liquid droplets are sprayed from very fine nozzles onto well-defined points on a substrate. The color mixing is in this case carried out with up to eight colors per point. Each of the eight colors can be applied in 256 levels. In spite of this variety of colors, the color space which can be obtained is limited in comparison with the color space of the screen printing method.

Thus, inkjet printing methods do indeed have the advantage that it is possible to avoid the elaborate production of stencils, that they furthermore make it possible to print without regard to register, and that it is unnecessary to premix color pastes. However, industrially usable production systems which make it possible to produce large yardages have not yet successfully been made. Individual systems have to date operated in the field of patterning with a printing speed of at most 1 m/min., while the average printing speed of a rotary printing machine is about 40 to 120 m/min.

It should moreover be taken into account that, with the inkjet printing methods, the droplets are formed within very fine nozzles having diameters in the micrometer range, for example 10 $\mu$m. These fine nozzles therefore unavoidably give rise to the problem of their clogging. With such nozzles, it is therefore only possible to use particular categories of color in highly pure form for printing, in order to minimize the risk of the nozzles clogging. The color space is accordingly also limited, and the use of, for example, metallic colors which are needed in fashion to obtain an iridescent effect, is out of the question.

A replacement for screen printing with stencils, which is suitable for mass production, has thus not yet been successfully found.

From the abundant prior art, only a few documents will be dealt with below by way of example:

DE 31 37 794 C2 describes a device for continuously delivering a minimal amount of liquid to a web of material.

This device has a fine-meshed screen and a blowing device directed against the screen. The screen rests in this case as a textile mesh belt without pressure on the web of material, or is guided or laid over it, and the blowing device is arranged above the mesh belt section carrying the ink.

As a supplement to this, DE 31 46 828 C2 proposes using a bath as a liquid delivery device, and arranging the blowing device behind and at a higher level than the delivery device in the running direction of the endless screen belt. Such a device could per se be used for patterning/printing if etching is carried out beforehand.

DE 40 01 452 A1 describes a device for continuously delivering a liquid to a web of material, having a moving screen, means for filling the openings in the screen and a blowing device for transferring the liquid held in the openings in the screen onto the web of material. The device for filling the openings in the screen consists of chambers which are arranged opposite one another on both sides of the screen and bear on the screen, one chamber being designed as a feed chamber and being connected to a liquid feed, while the other chamber is designed as a discharge chamber and is connected to a liquid drain.

Furthermore, DE 42 28 177 A1 discloses a device for continuously delivering a liquid to a web of material having a moving screen, having filling chambers which are arranged opposite one another on both sides of the screen and extend over the width of the screen, squeegees engaging the screen on both sides and a blowing device which is made of an elongate nozzle which extends over the width of the screen and is cooperating with a propellant feedline. In order for it to be possible to adjust the delivery of liquid continuously to the width of the web of material, each filling chamber has a piston which is guided in leaktight fashion against the screen and can be moved continuously starting from one end of the filling chamber, the elongate nozzle cooperating with a closure belt which can be moved continuously from one end of the elongate nozzle and allows the elongate nozzle to be closed off to a greater or lesser extent.

Lastly, AT-PS 175 956 furthermore discloses a method and a device for applying liquid materials to a base. The nozzles, which are arranged behind a screen, can likewise be adjusted individually in order to control the respective amounts delivered. This method and this device are used, however, not to pattern the base but instead to coat it so as to provide it with uniform delivery. Through the arrangement of a covering mask, it is possible to adjust the distribution of a medium, taken from a container, on the substrate in a fixed ratio. The use of such masks is, however, not comparable with patterning which can be achieved by printing. Furthermore, no consideration is given here either to the synchronization between the delivery and base which is per se necessary and suitable for patterning.

SUMMARY OF THE INVENTION

The object of the invention is to provide a device and a method for applying a medium in liquid, powder or paste form to a substrate for forming a pattern on the substrate, it being possible for a pattern to be applied without the use of etched stencils with, in comparison to inkjet methods, considerably increased printing speed irrespective of registers, customary color categories being usable and the purity of the colors requiring no particular precautions.

A further object is to provide a system which makes it possible to use a plurality of such devices.

The invention is advantageously used for applying a pattern to large area substrates, in particular textile goods, for applying printing ink to particular regions of a printing support and for applying media for patterning supports for printing, especially screen printing, made of metal or plastic.

The device according to the invention and the method according to the invention firstly propose, as a complete departure from the prior art, a separation between the propellant for propelling the medium, that is to say preferably a printing substance, to the substrate and the medium itself. In order to achieve this separation, the liquids used for the medium, for example solutions, dispersions, suspensions etc., or pastes and powders, are distributed in a transport device, preferably in discrete form. In the case of media in liquid or paste form, a capillary action due to small openings in the transport device is employed for filling this device. Specifically, this brings about spontaneous "filling" of the small openings, which leads to virtually "automatic" metering. After apportioning (if necessary) of the medium which is optionally carried out using squeegees, it is transported into the desired delivery zone and delivered from there by the propelling device which is adapted for propelling medium from selectable points of the delivery zone, the propelling device being controlled for selecting said points. The propellant preferably is a fluid, i.e. a liquid or a gas, in particular air. In the case of using a gas as the propellant, a pressure range of between $10^3$ and $10^6$ Pa (0.01 and 10 bar) is used.

Delivering the medium from selectable points of the delivery zone can be used directly (hereinafter: "direct method") or indirectly (hereinafter: "indirect method") for forming a pattern on the substrate, although the direct method and the indirect method share the same inventive idea, and should be regarded as mutually "inverted" printing methods.

In the direct method, the medium propelled from the delivery zone is transferred directly to the substrate, and forms a part of the desired pattern on the substrate. In the indirect method, the medium propelled from the first delivery zone is not transferred to the substrate, but merely removed from the transport device. The medium remaining in the transport device is transferred to the substrate with a delivery device which may be e.g. in the form of a conventional blade squeegee or roller squeegee device (in which the transport device is in contact with the substrate), or may alternatively be a non-selective propelling device (in which the transport device is not in contact with the substrate), e.g. of the type disclosed in AT-PS 175 956. Consequently, in the direct method and the corresponding device, the propelling device selectively propels the medium which is to be transferred from the transport device to the substrate, while in the indirect method and the corresponding device, the propelling device selectively propels the medium which is not to be transferred from the transport device to the substrate.

In a preferred embodiment of the method and device according to the invention, as a propellant short gas pulses are used, which can be selectively released from nozzles connected with controllable valves, thereby selectively releasing amounts of medium from the transport device, in the direct method onto the substrate over its width and length, and in the indirect method into a collecting device, preferably for recycling. The patterning is thus carried out by separating the medium or printing substance from the propellant. Namely, whereas in the case of the existing nozzle devices and methods for delivery to a substrate, a pre-pressurized liquid is used and is converted into droplets by thermal expansion or alternating piezoelectric voltages, a procedure of this kind is superfluous, and moreover unusable, in the device according to the invention and in the method according to the invention. The propellant is blown in the form of gas, preferably air, onto the medium, so that the medium is transferred onto the substrate in the desired way (direct method), or removed from the transport device whereby the remaining medium is delivered to the substrate in the desired way (indirect method).

Any problems in terms of cleaning the nozzles and their clogging are eliminated in the device according to the invention and in the method according to the invention, since in this case the nozzles merely output gas pulses and do not spray the medium.

In the device according to the invention and the method according to the invention, the information which the pattern contains for the respective colors can be obtained from a computer which actuates the nozzles accordingly, so that they deliver the gas pulses in correspondence with the desired pattern.

As is known, the resolution of screen printing is a decisive parameter for its quality. In all screen printing methods and devices, the resolution (that is to say the density of the individual printing points) is rigidly dictated by the resolution of the stencil. This is due to the fact that screen printing methods and devices work exclusively using contact with the substrate, and the velocity between the substrate and the stencil always has, apart from small frictional effects, the same value.

In this regard as well, the present invention in the direct method provides considerable advantages through a resolution that can be varied in a wide range. This variable resolution is actually achieved by separation of the propellant for applying the medium to the substrate from the medium, or printing substance, itself and furthermore by the possibility of adjusting a relative velocity between the transport device, or delivery device, on the one hand, and the substrate, on the other hand, and by the possibility of matching the resolution by appropriately increasing the frequency with which the propellant is sent from the delivery device to the transport device, in order to supply the medium from the latter to the substrate without contact between the transport device and the substrate.

Through selective actuation of individual nozzles in pattern-related synchronization with the substrate, it is possible to transfer arbitrary patterns using the device according to the invention and the (direct) method according to the invention, while also increasing the speed of the transport device so as thereby to achieve variable resolution on the substrate. For example, by doubling the rotational speed of a transport drum which forms the transport device relative to the substrate, and doubling the delivery frequency of the gas pulses, a two-fold increase in the point density on the substrate can be achieved. It is therefore possible to transfer large amounts of colors onto the substrate, which is a great advantage especially in the textile printing industry.

One possible way of patterning a substrate in the direct method consists in moving the substrate to be printed past the device according to the invention, or a system containing a plurality of such devices. The delivery is then carried out selectively over the width of the substrate, and its length, in order to transfer the desired pattern to the substrate without contact.

It is, however, also possible to move the device or the system past a fixed substrate to be printed, or appropriately scan this substrate, while delivering the pattern in the desired way to appropriate regions of the substrate.

In the indirect method the invention provides considerable advantages through the selective delivery of medium in a pattern related synchronization with the substrate, with which is not only possible to transfer an arbitrary pattern, but also to transfer relatively high amounts of medium suitable for textile printing. Substrates can be patterned with high speed, with well known media, and without register. The medium remaining in the transport device, such as a drum or belt, after removal of medium in the propelling device, can be transferred to the substrate by a non-selective propelling device, or e.g. by a well known squeegee operation.

Very precise patterns can be transferred to a substrate using the device according to the invention and the method according to the invention. Care merely needs to be taken in this case that the transport device, e.g. the transport drum provided with holes, or the screen or else a mesh belt guided by rollers, is produced with high accuracy and runs true. This can be readily ensured by electrolytic production of the screen and by a suitable drive mechanism, so that the required balanced running accuracy and synchronization between the transport device and the substrate is achieved.

A further advantage of the invention (direct method) is that the medium is delivered without contact and adhesive bonding, for example of a web of textile goods onto a back cloth in the conventional sense can per se in principle be omitted, although it does not have to be omitted.

The aforementioned synchronization of the transport device with the motion of the substrate can, for example, be achieved by establishing the position of the transport device using an encoder and employing the signal supplied by the encoder to synchronize the gas pulses with the position of the transport device. It is, however, also possible to measure the position of (possibly encoded) individual holes of the transport device, in particular a transport drum, during operation and match the actuation of the valves which supply the gas pulses appropriately to the desired pattern. Electromagnetic acquisition has proved particularly advantageous for ascertaining the position of the transport device. Optical or capacitive acquisition is, however, also possible.

In the above the propelling device has been described as a device delivering gas pulses for conveying medium from a transport device. It is, however, also possible to provide the propelling device with one or more heating devices, e.g. a laser device or a high frequency device, for producing a thermal delivery of amounts of medium from the transport device. One or more of the heating devices can be arranged over the width of the transport device. Laser radiation with d- suitable wavelength can be directed with optics such that separate amounts of medium are released in an explosion-like way due to a very rapid heating, which will be particularly advantageous in the indirect method according to the present invention. A similar effect can be obtained by directional high frequency heating. Another way of delivering amounts of medium is electrostatically.

In the screen printing methods currently carried out, a substrate already prepared for printing, or an article, is customarily subjected to the printing process. In the case of processing natural fibers as a textile substrate, this means that the article has been scoured, decocted and bleached and has a degree of whiteness deemed suitable for printing. These articles which are white enough for printing are then fed dry to the printing process.

Of course, printing on textile goods as a substrate should be guaranteed to have the sharpest possible contours. However, the use of a medium or printing substance with low viscosity, such as the viscosity of a conventional textile printing paste, may be required for technical reasons. Unfortunately, this low viscosity may lead to a lower quality in the resolution and edge sharpness of the printing. Also, the color retention capacity in the case of printing on fabrics and knitwear is poor. Furthermore, because of the existence of a texture, there is a tendency for the printing substance which has been delivered, if it is fluid, to spread or run. In this case as well, it is difficult to form a sharp printing pattern. Optimization should be carried out in this case, but without causing degradation of the other properties of the textile substrate. This is achieved according to the invention through the possibility of having some of the chemicals needed to improve the process delivered to the substrate prior to the actual printing process. These chemicals, also referred to as printing aids, may with this procedure be delivered to the dry substrate, which in other regards has already been prepared for printing, for example with a foulard (bath) or another suitable delivery unit. In certain cases, the delivery of wet printing aids to a wet substrate may also be envisaged. After this, the substrate is then dried to an acceptable residual moisture content of, for example, from 2 to 15% in order for the actual printing process then to be carried out. This entire process step may be carried out both in stages and continuously in one working step.

In printing processes generally premixed colors are used. However, according to the invention it is also conceivable to use primary colors, and to mix these directly on the substrate. This method is already known as "multichromy", in particular "quadrochromy" or "octochromy", and is used in inkjet printing and flat bed printing. The advantage of this method is that metering and mixing of colors can be omitted completely. This is a considerable environmental advantage, since extensive cleaning of buckets and other containers are unnecessary. The number of necessary stencils is reduced, which reduces costs.

The substrate may be a printing support, e.g. a printing roll or printing plate. With the invention, it is possible to feed ink to this printing support in a simple 30 way, with a high degree of control, only over a desired, rather than the entire, width or area. The substrate may comprise metal, plastic, rubber etc.

The substrate may also be a printing form, e.g. a printing screen, for forming a screen printing stencil which is to be provided with a patterning medium. This medium can be a patterning lacquer, a patterning resist, a wax or an ink.

It is to be observed that the method according to the invention can also be used for producing a conventional patterned printing form, in particular a patterned printing screen or stencil, by providing the printing form with a pattern of lacquer or resist. In the indirect method according to the invention, the transport device is a screen, and the medium is the lacquer. The propelling device is used to remove lacquer from selected holes of the screen, which holes are to be used to let pass a printing substance during the use of the printing screen thus obtained.

The claims and advantages will be more readily appreciated as the same becomes better understood by reference to the following detailed description and considered in connection with the accompanying drawings in which like reference symbols designate like parts.

DESCRIPTION OF THE PREFERRED EMBODIMENTS

Figure 1:
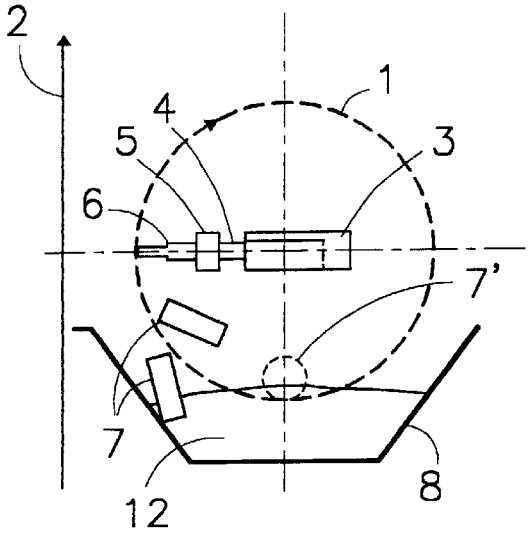
FIGS. 1 to 3 show schematic sectional representations of various illustrative embodiments of the device according to the invention.

FIG. 1 schematically shows a first illustrative embodiment of the device according to the invention, having a transport device 1 which consists of a transport drum in which openings have been made with a suitable hole density, so that the transport device 1 forms a "screen". Instead of a transport drum it is also possible here, as well as in the illustrative embodiments which follow, to use a belt provided with holes (hereinafter: mesh belt) guided over two or more rollers. This transport device 1 is, for example, driven on one side by a motor (not shown) via a gear mechanism (not shown). A substrate 2 of, for example, textile goods is moved past the transport device 1, without contact, in the direction of the arrow. The transport device 1 contains a delivery device made of an air feed 3, a connecting piece 4, a valve 5 and a nozzle 6, which form the overall pneumatic arrangement of the device. Two squeegees 7 serve to apportion the medium 12 entrained from a container 8 in the form of a printing substance. Instead of squeegees (as schematically indicated), it is also possible to use squeegee rollers (cf. 7'), or squeegees and squeegee rollers.

The connecting piece 4, the valve 5 and the nozzle 6, and where appropriate the air feed 3 as well, may have an integral or monobloc design if this is expedient, for example, for manufacturing reasons or for reasons of space.

When the transport device 1 rotates in the direction of the arrow, it takes the medium 12 from the container 8 and transports it upwards (in FIG. 1). The squeegees 7 are set such that excess medium is taken off the transport device 1 and falls back into the container 8.

The air feed 3 receives pressurized air. Another suitable gas may, of course, also be used instead of air as the propellant. In any case, the air from the air feed 3 reaches the valve 5 via the connecting piece 4. This valve 5 may be controlled electrically in synchronism with the motor for the transport device 1, and in accordance with a pattern to be delivered to the substrate 2, using a central processing unit (not shown). If there are a plurality of printing stations (cf. FIG. 9), it is also possible to control decentralized, using a plurality of control units, each printing station being for example associated with one decentralized control unit. The valve 5 opens, in particular, with a frequency of for example from 0.1 kHz to 10 kHz, so that pressurized air is driven from the air feed 3 via the connecting piece 4 and the valve 5 to the nozzle 6 in order to deliver the medium 12 from the transport device 1 to the substrate 2 with the desired patterning. The distance between the transport device 1 and the substrate 2 is, for example, from 0.1 to 100 mm and, preferably, from 1 to 10 mm. The distance between the nozzle 6 and the transport device 1 may be between 0.01 and 10 mm, and preferably between 0.1 and 2.0 mm. For special applications, it is even possible to go below the lower limit.

A suitable pressure range for the pressurized air is from $10^3$ to $10^6$ Pa (0.01 to 10 bar).

Figure 10:
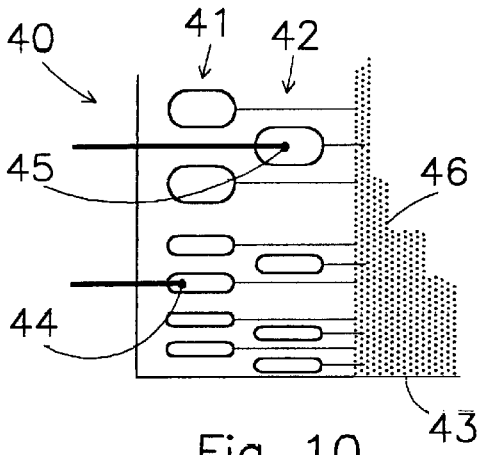
FIG. 10 shows a part of a transport drum with an encoder.

The rotational speed, as well as the position of the holes of the transport device 1 may be measured by an encoder 40, illustrated in FIG. 10. The encoder 40 comprises two series of holes 41, 42 provided along and near an edge of a transport drum or rotary screen 43, the holes 41, 42 being detected without contact by sensors 44, 45, respectively, such as sensors for reflected light, sensors for transmitted light, air flow sensors, electromagnetic sensors, etc.. The holes 41, 42 have a predetermined and fixed relationship to holes 46 in the transport drum 43, thus allowing for determining, controlling and checking the rotary position and speed of the transport drum very accurately. It is also possible to establish this rotational speed by measuring the speed of the holes 46. If holes at both ends of the transport drum measured, possible torsion of the transport drum can be monitored. In any case, the rotational speed of the transport device 1 is synchronized with the frequency for actuating the valves 5 for the nozzles 6 and with a pattern to be applied to the substrate 2. The rotational speed of the transport device 1 may be greater than or less than, or equal to the speed of the substrate 2.

The transport device 1 and the substrate 2 may move counter one another, which is advantageous for light/dark and color-saturation control as a consequence of the slower "stencil run" which this causes.

During operation of the device in FIG. 1, the transport device 1 takes the medium 12 from the container 8 in such a way that the medium 2 is distributed essentially uniformly in the longitudinal plane of the transport device 1, that is to say in FIG. 1 at right angles to the direction of the drawing, i.e. in the longitudinal direction of the transport drum which forms the transport device 1. Using the pressurized air which is fed via the air feed 3, the medium 12 is transferred through the nozzles 6, by means of the pressurized-air pulses, in a controlled way onto the substrate 2 which is moving at right angles to the longitudinal axis of the transport drum.

The medium 12 is delivered to the substrate 2 without contact between the transport device 1 or the nozzle 6, on the one hand, and the substrate 2 and the transport device, on the other hand. It is, of course, also possible to use patterned stencils for transferring the pattern if, for example, all of the nozzles are being used in continuous operation.

The nozzles 6 may be free to tilt over an angle of ±90° relative to the delivery zone, i.e. 45° up or down in FIG. 1, e.g. for presetting purposes.

Further illustrative embodiments of the invention will be explained below with reference to FIGS. 2 to 9, the already described configuration of the illustrative embodiment in FIG. 1, or its mode of operation, being correspondingly applicable to these further illustrative embodiments.

Figure 2:
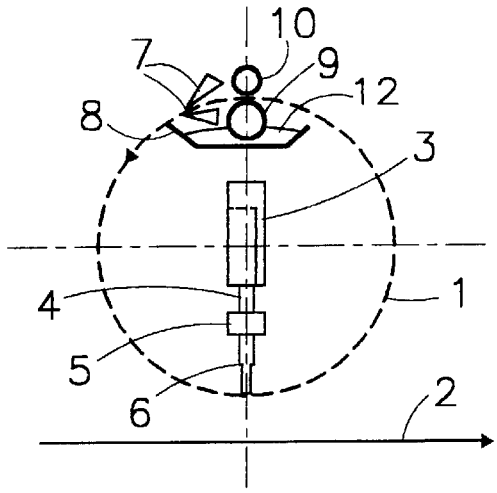

In contrast to the illustrative embodiment in FIG. 1, which uses a horizontal nozzle arrangement, a vertical nozzle arrangement is provided in the illustrative embodiment in FIG. 2. The substrate 2 is in this case moved horizontally past, and below the transport device 1 in the direction of the arrow. As in the illustrative embodiment in FIG. 1, firstly the transport device 1 contains on the inside the air feed 3, the connecting piece 4, the valve 5 and the nozzle 6. As a supplement to the illustrative embodiment in FIG. 1, the container 8 for the medium 12 and a delivery roll 9 are also arranged inside the transport device 1 in the illustrative embodiment in FIG. 2. This delivery roll 9 takes the medium 12 from the container 8 and delivers it to the transport device 1, a magnetic or mechanical mating roll 10 exerting a compensating pressure on the delivery roll 9 contacting the transport device 1. The amount of medium 12 delivered is again apportioned by the squeegees 7, which are provided in the running direction (cf. the arrow) of the transport device 1, behind the rolls 9, 10. As has already been mentioned, the schematically represented squeegees may also be fully or partially replaced by squeegee rollers, for the purpose of apportioning the medium.

Figure 3:
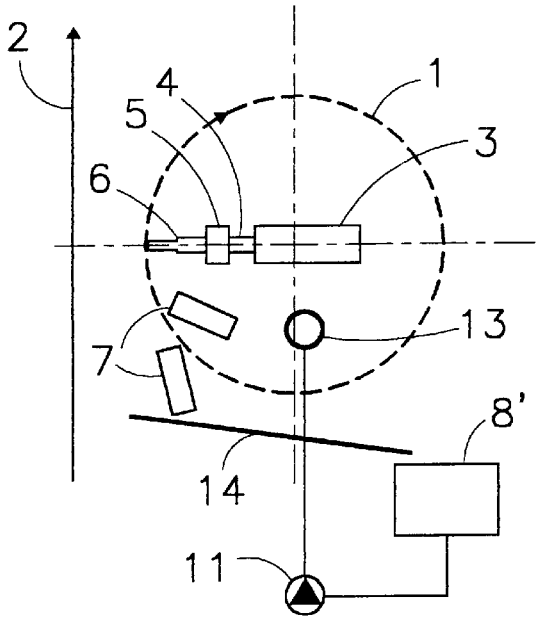

FIG. 3 shows a third illustrative embodiment of the device according to the invention, which differs from the illustrative embodiments in FIGS. 1 and 2 by the way in which the medium 12 is fed into the transport device 1: in the illustrative embodiment in FIG. 3, there is a storage container 8'outside the transport device 1, and this is connected via a pump 11 to a feed tube 13 inside the transport device 1. This feed tube 13 has perforations in its longitudinal direction, which caters for uniform distribution of the medium 12 over the longitudinal direction of the transport drum forming the transport device 1. A run-off plate 14 provided below the transport device 1 takes excess medium 12 and returns it to the container 8'. Such a run-off plate 14 may, of course, also be provided in the illustrative embodiment in FIG. 2 if need be.

Figure 4:
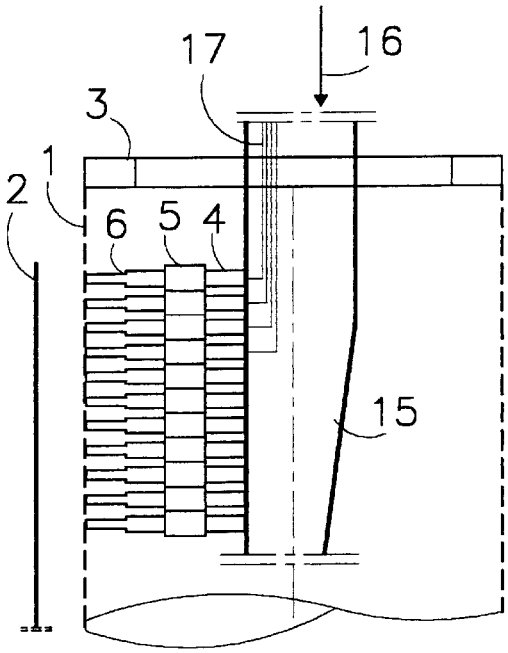
FIG. 4 shows a schematic plan view of a further illustrative embodiment of the device according to the invention.

FIG. 4 shows a plan view of an illustrative embodiment of the invention, an air-feed shaft 15 being in particular shown here for the air feed 3. This air-feed shaft 15, which like the air feeds 3 in the illustrative embodiments in FIGS. 1 to 3 run inside the transport device 1, has a cross section with decreasing area in order to compensate for the hydrostatic pressure drop and to obtain the most uniform possible prepressurization at the individual valves 5, so that the valves 5 actuated via control lines 17 in accordance with the pattern to be created, receive the same pressure as far as possible. The air itself is in this case input in the direction of an arrow 16 into the air-feed shaft 15.

Figure 5:
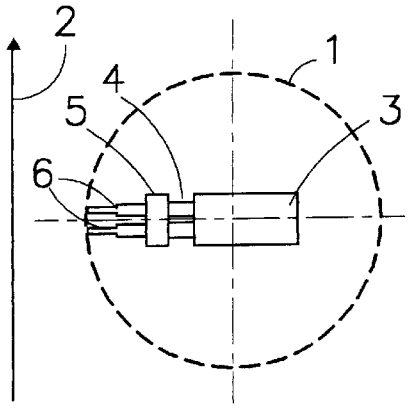
FIG. 5 shows a schematic sectional representation of a further illustrative embodiment of the device according to the invention.

FIG. 5 shows an illustrative embodiment in which two rows of nozzles 6 with corresponding valves 5 and connecting pieces 4 are provided. If need be, depending on the field of use of the device in question, it is even possible to arrange a larger number of rows of nozzles above one another, and at the same time offset or obliquely relative to one another. With such a multirow arrangement of nozzles 6, the resolution can be varied over the width of the substrate 2, or over the longitudinal direction of the transport drum which forms the transport device 1, with the possibility of also matching the speed at which the transport device 1 runs or at which the substrate 2 is moved. It has been shown that a 2- to 16-row, preferably 4-to 10-row arrangement of nozzles is advantageous.

Figure 5B:
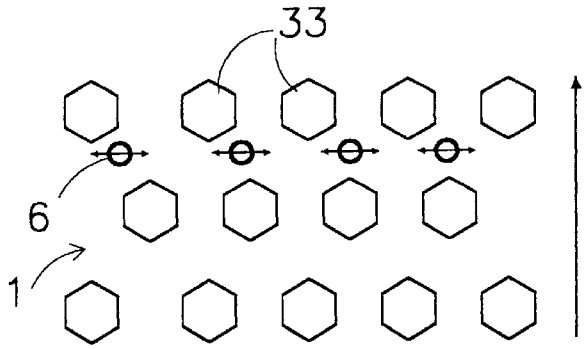
FIG. 5*b* shows an advantageous refinement of nozzles and transport devices in plan view.
Figure 5A:
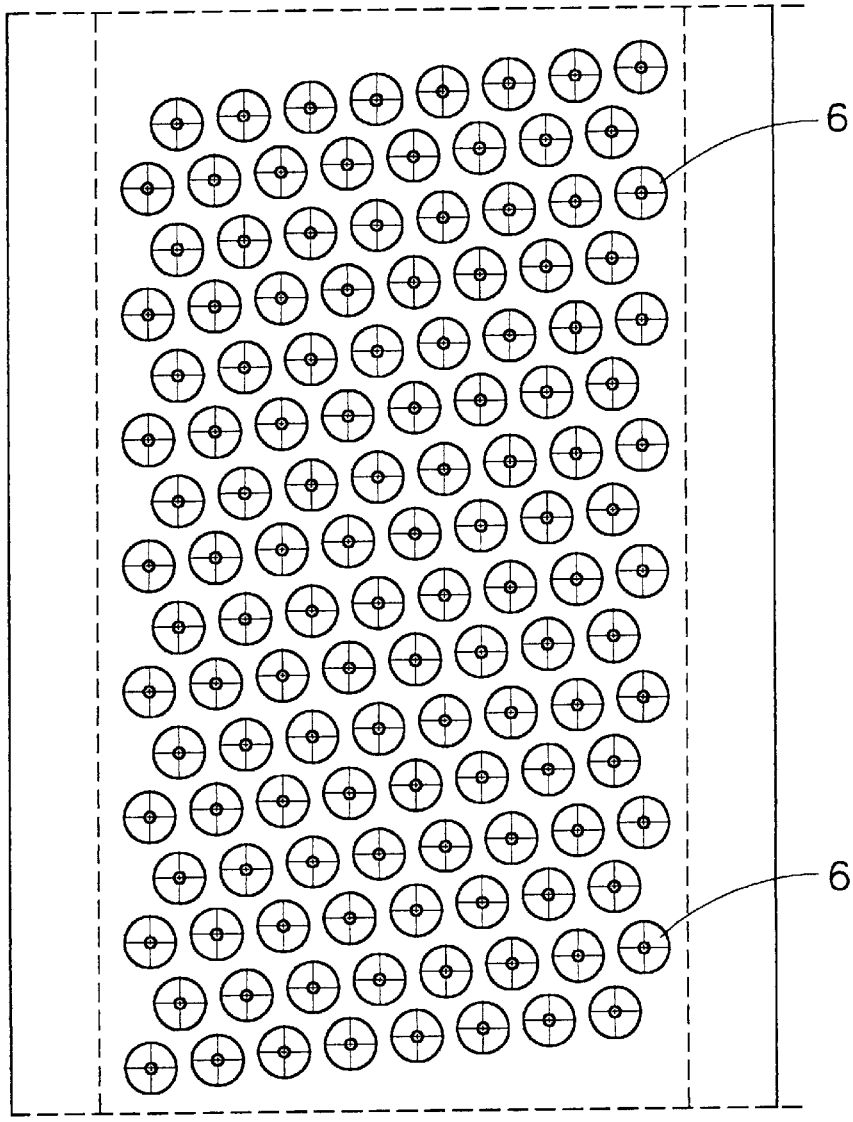
FIG. 5*a* shows a plan view of a nozzle plate.
Figure 6:
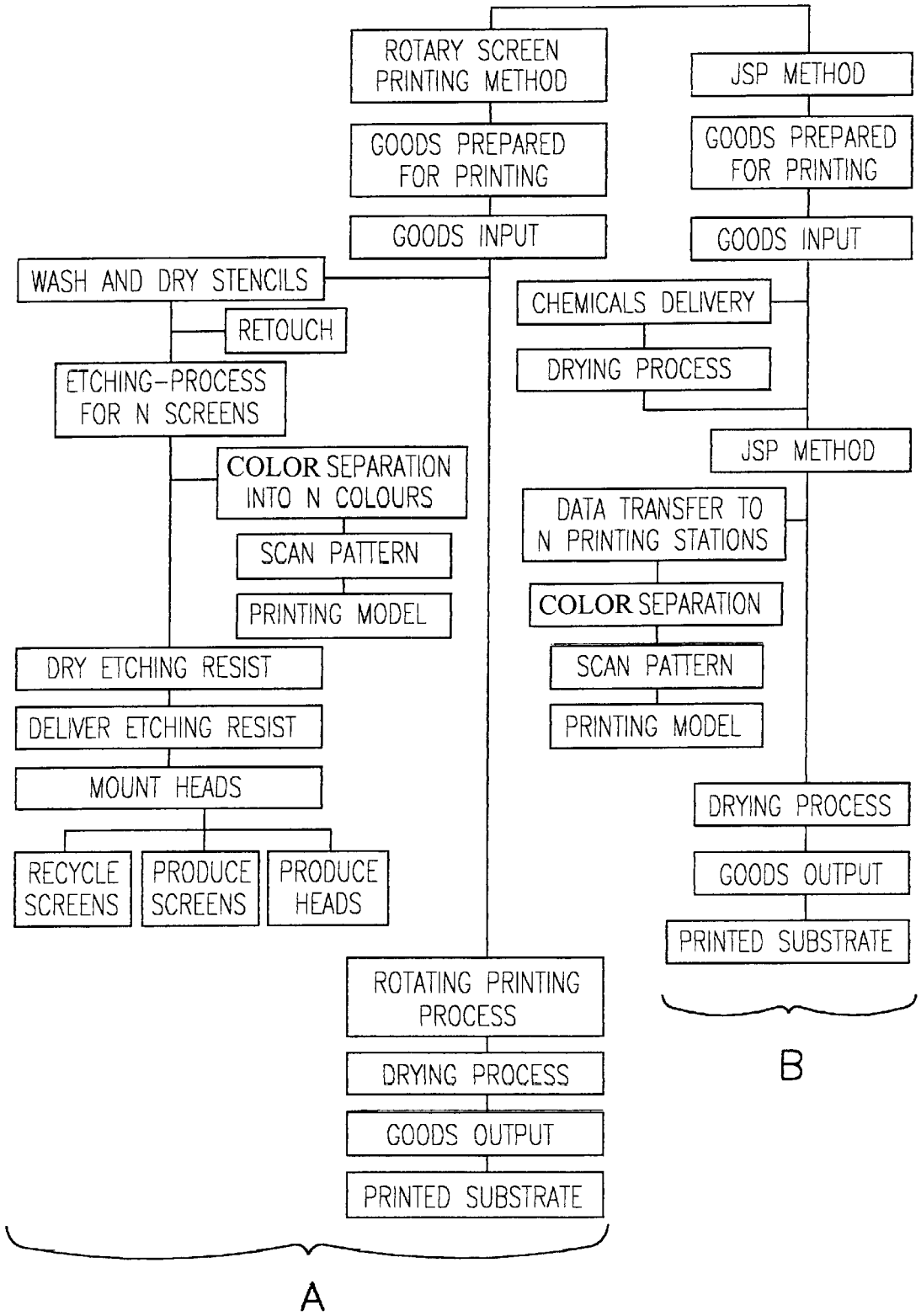
FIG. 6 shows a block diagram for clarification of an illustrative embodiment of the method according to the invention.

FIG. 5*a* shows a plan view of a nozzle plate, in which 16 rows of nozzles 6 are provided offset relative to one another.

FIG. 5*b* shows an arrangement of nozzles 6, in which these are fixed in the direction of motion of the transport device indicated by the large arrow, but displaceable at right angles relative to the direction of motion of the transport device indicated by the small arrows, that is to say at right angles to the rotational motion of the transport drum, with a suitable frequency by for example half of one hole separation each. This makes it possible to expel medium from the openings 33 of the transport device 1 with a reduced number of nozzles 6. If, for example, the nozzles 6 are thus arranged in the middle between two openings 33, then the left-hand or right-hand opening 33 may respectively be used by displacement through one half of the opening separation, respectively. Such displacement could, for example, be carried out in a suitable way by a piezoelectric drive for individual valves, or alternatively for the entire row of nozzles.

As already mentioned at the start, it may be expedient for a printing aid, for example special chemicals, to be delivered using a foulard or a suitable delivery unit prior to the actual printing process, in the case of a textile substrate referred to in the prior art as pressure-pretreated goods. The means adopted for this, or corresponding procedure, is illustrated by a "loop" in FIG. 6, the left-hand half of which (part "A") shows the prior art, while the application of the method according to the invention ("JSP" or "Jet Screen Printing" method) is represented in the right-hand half (part "B"). In part "B" the "loop" with "chemical delivery" and "drying process" is not carried out in the normal case.

If, however, printing aids or chemicals are delivered and a drying process is thereupon carried out, then the printing process is subsequently carried out in accordance with the method according to the invention. Furthermore, where appropriate, it is also possible for "wet in wet" delivery of the printing aids or chemicals to be performed, this being followed by drying the substrate 2 to a desired residual moisture content of, for example, practically 0 to 50%, in particular 2 to 15%, before the method according to the invention is implemented. The process step in which printing aids are delivered may be carried out both discontinuously and continuously in one working step with implementation of the method according to the invention.

In all the illustrative embodiments of the invention, the medium 12 to be applied is apportioned by the squeegees 7 while being limited to the extent of the opening volume of the holes in the transport device 1. The amount of medium 12 transported, which is then very accurately determined by the holes in the transport device 1, is discretely distributed over the width of the web of the substrate 1. Each hole entrains a very well-determined amount of medium in the range of a few nl. The droplets which have thus been premetered are delivered by means of the gas pulses from the nozzles 6, fed synchronously in relation to the motion of the transport device 1. Through synchronization of the gas pulses from the nozzles 6 with the rotational motion of the transport device 1, and matching to the speed of the substrate 2, then with selective release of the individual droplets an arbitrary pattern can be transferred without contact to the substrate 2, over its width and length.

Figure 7:
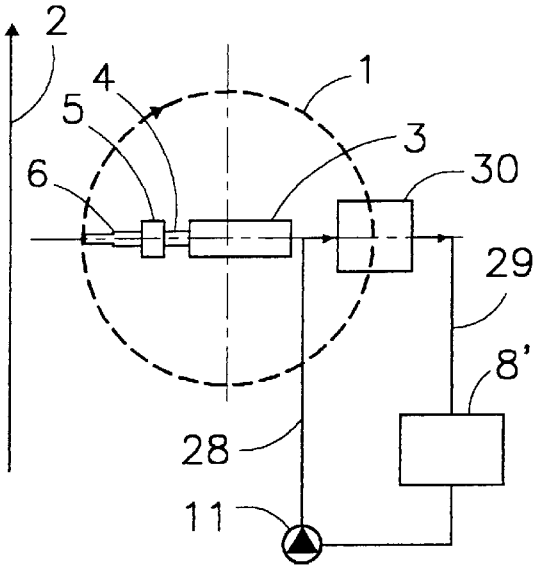
FIG. 7 shows a schematic sectional representation of a further illustrative embodiment of the device according to the invention with a closed feeding system for the medium.

FIG. 7 shows an illustrative embodiment of the invention with closed feeding of the medium to the transport device 1. The principle of this is that the liquids, such as solutions, dispersions, suspensions or pastes, are fed from the storage container 8'by the pump 11, via a line 28, to a closed filling chamber 30 which may or may not be partitioned over the width of the transport device 1, and these liquids are taken up from here into the screen of the transport device 1. To this end, the filling chamber 30 is provided with a venting device for allowing air which has entered to escape. It is optionally possible to omit the apportioning by squeegees.

In one variant, it may be advantageous according to the invention to re-collect excess substance in the storage container 8'via a discharge line 29.

Figure 8:
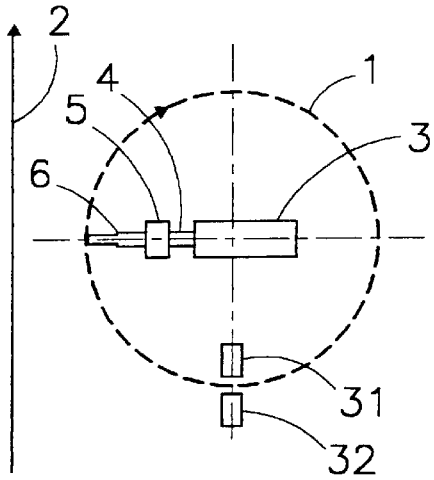
FIG. 8 shows a schematic sectional representation which clarifies how a hole detection can be carried out for synchronizing operation, in the device according to the invention.

FIG. 8 schematically shows how, in the device according to the invention, a hole detection in the screen of the transport device 1 can be carried out. It is per se also possible, as already explained above with respect to FIG. 10, for "indirect" hole detection to be carried out using an encoder directly connected to the transport device 1. It is, moreover, also preferably possible to carry out electromagnetic hole detection using a transmitter 31 and a receiver 32. It should be noted here that the hole detection or the use of an encoder is not limited to the present invention, but can also be used in conventional screen printing devices.

Figure 9:
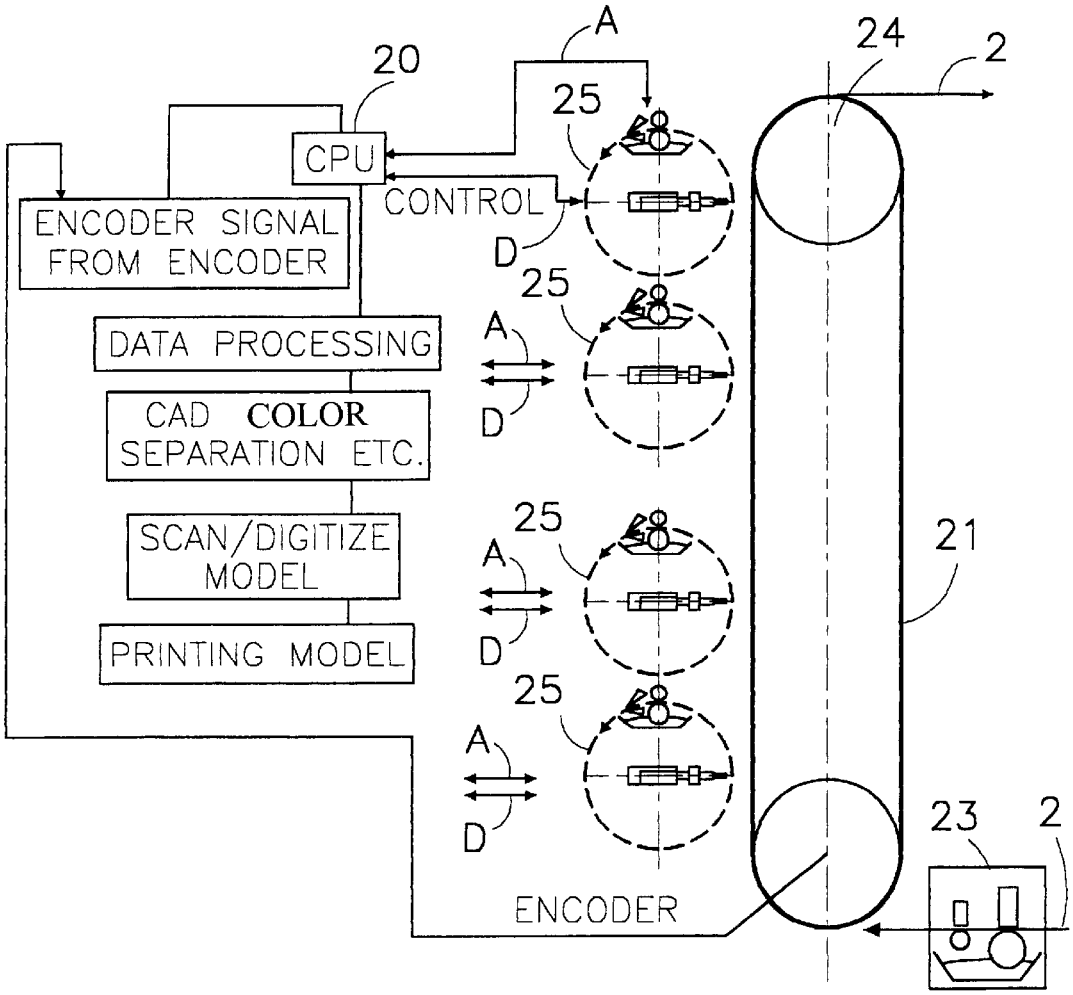
FIG. 9 shows a schematic sectional representation of a system according to the invention having a plurality of devices for applying a medium to a substrate.

FIG. 9 shows an illustrative embodiment in which a plurality of printing devices or assemblies 25, each corresponding to one of the illustrative embodiments in FIGS. 1 to 5, are arranged one after the other along a conveyor belt 21. A substrate 2 is carried on this conveyor belt 21, which is driven by a main drive 24, and the substrate 2 is adhesively bonded to the conveyor belt 21 with the aid of an adhesive-bonding device 23. The main drive 24 of the conveyor belt 21 is connected to an encoder where the substrate 2 enters. Each of the printing assemblies 25 is connected to a drive unit or a geared motor. FIG. 9 schematically represents four printing assemblies. If need be, however, it is also possible for a plurality of such printing assemblies, for example six printing assemblies, to be provided. The overall system is controlled either using a central processing unit (CPU) 20, which is respectively connected for drive A and nozzle control D (cf. the corresponding double arrows) to the individual printing assemblies 25, or not centrally, with each printing assembly being associated with a central processing unit. The central processing unit 20 is fed the pattern data of a printing model, by firstly scanning or digitally creating the latter, and then subjecting the result to CAD color separation and conditioning ("CAM preparation"). The encoder signal is used for synchronization and is communicated to the central processing unit 20 or central processing units of the individual printing assemblies.

With the system shown in FIG. 9, consisting of a plurality of devices 25, a multicolor pattern can be transferred to an extremely wide variety of substrates 2, irrespective of the register, if each printing assembly 25 is allocated a particular color.

Figure 11:
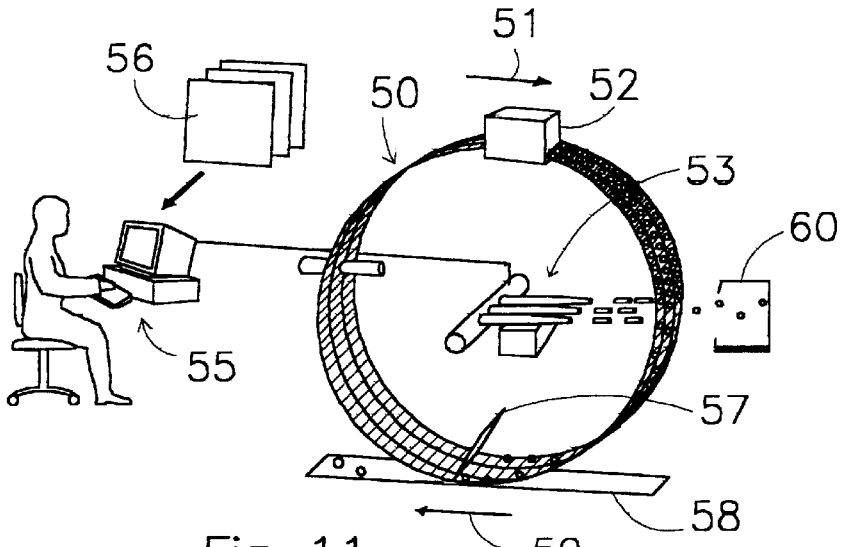
FIG. 11 shows a schematic perspective view of a further device according to the invention.
Figure 12:
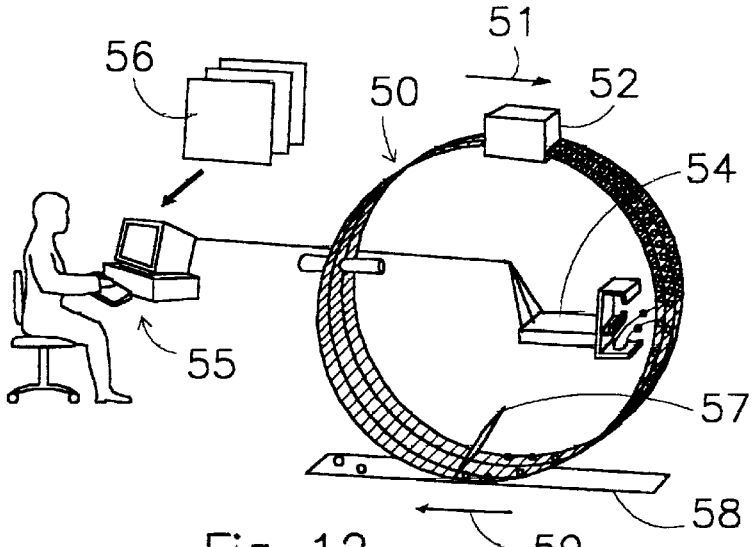
FIG. 12 shows a schematic perspective view of another embodiment of the device of FIG. 11.

FIG. 11 and 12 illustrate the indirect method according to the invention. A transport drum 50 provided with holes is rotated in the direction of arrow 51, and takes up medium in each of its holes from a container 52. A propelling device 53 (FIG. 11) or 54 (FIG. 12) selectively removes the medium from predetermined holes of the transport drum 50. The propelling devices 53, 54 are controlled by a computer 55, in which data relating to a pattern 56 to be printed is stored and processed. The medium remaining in the holes of the transport drum is transferred by an element 57, such as a squeegee or a non-selective propelling device to a substrate 58 moving in the direction of arrow 59. In FIG. 11 the propelling device contains valves and nozzles delivering gas pulses for bringing medium to a collecting container 60, while in FIG. 12 the propelling device contains controllable electrostatic heads selectively removing the medium at predetermined points from the transport drum 50.

Figure 13:
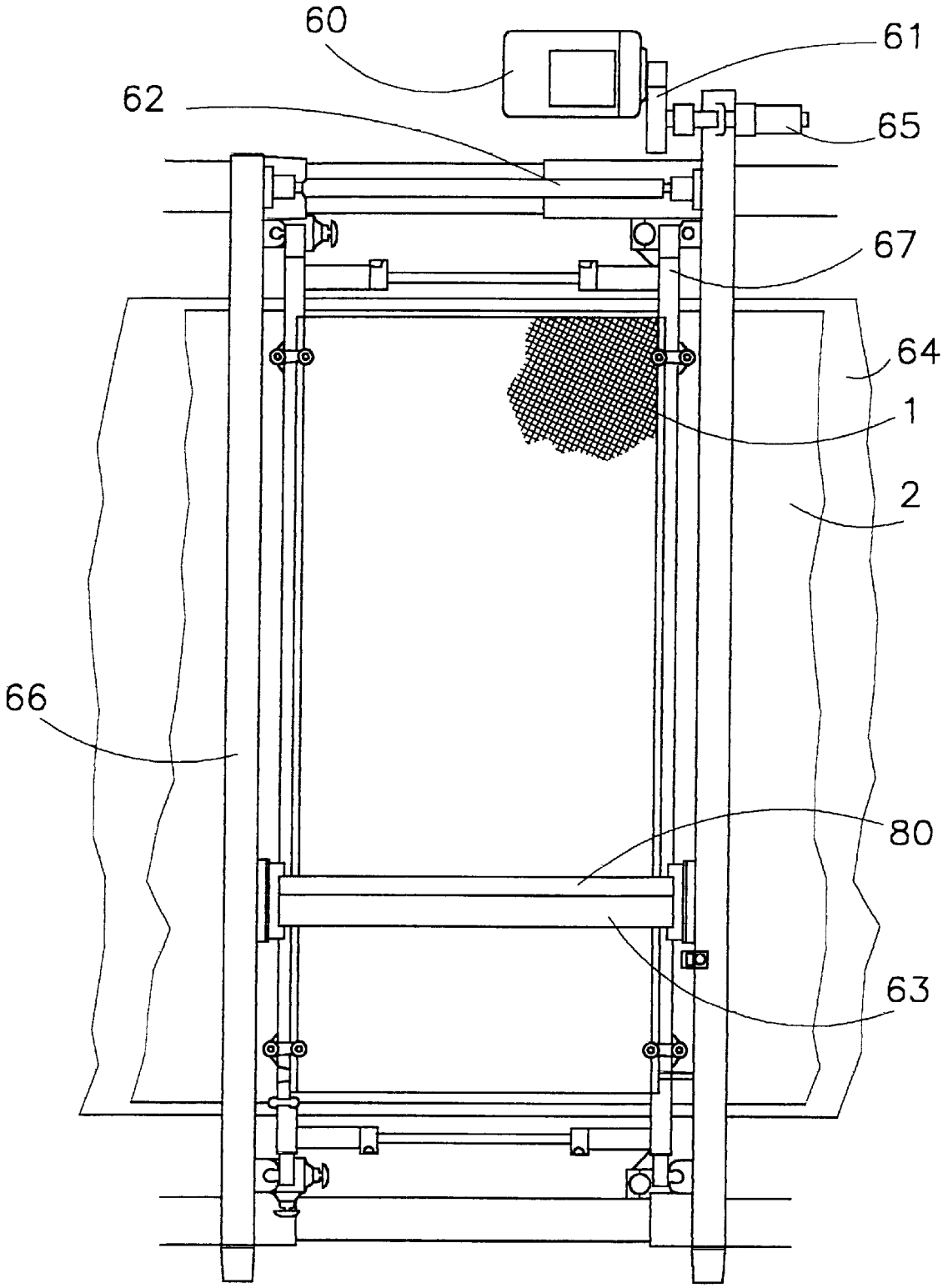
FIG. 13 shows a top view of a first embodiment of a planar device according to the invention.

FIG. 13 shows a planar container 67 containing a flat opened transport device 1 which is mounted in a frame 66. A medium 12 (not shown in the Figure) is distributed by an applicator device 63 that is driven by a motor 61 and drive shaft 62. Medium 12 is transferred contactless with a delivery device 80 over the whole width of a substrate 2 which is transported intermittently on a belt 64, e.g. from the device shown in FIG. 13 to a next one for applying a next colour. An encoder 65 provides the position of the applicator device 63 with reference to the transport device 1.

Figure 14:
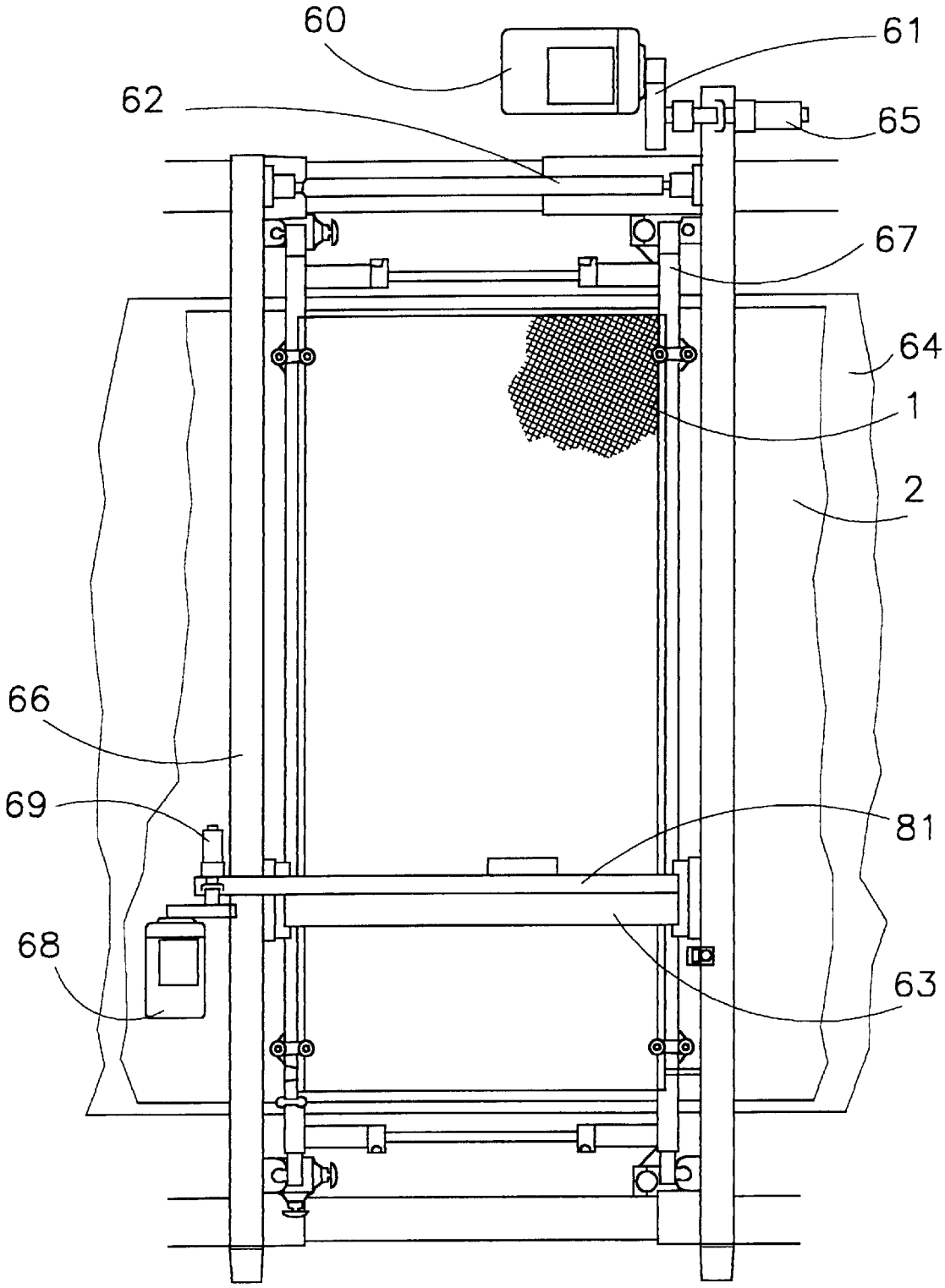
FIG. 14 shows a top view of a second embodiment of a planar device according to the invention.

FIG. 14 shows a modification of the device of FIG. 13 with a delivery device 81 which is not distributed over the whole width of the transport device 1, and instead is driven in the longitudinal direction of the applicator device 63 over the width of the transport device 1 by a second motor 68. This reduces the size of the delivery device 81. Via encoders 65 and 69 the position of the delivery device 81 is controlled.

The device according to the invention, and the method according to the invention, do not require the manufacture and patterning of stencils, as is currently necessary in the prior art. By selectively actuating a propelling device in synchronism with the movement of a substrate 2, and successive printing assemblies 25, any pattern can be made straightforwardly. The speeds which can be achieved are in this case at least of the order of the speeds of currently customary methods.

However, it is to be observed that the method according to the invention can also be used for producing patterned stencils, which can be used in the conventional way, by using an unpatterned printing screen as a transport device for transporting liquid lacquer as a medium, and using a propelling device for selectively removing the medium from holes of the printing screen, and thereafter drying the lacquer.

After pattern creation and colour separation, it is basically possible, in the method according to the invention, to work only with primary colours and to mix these directly on the substrate. The advantage of such a procedure is that it is entirely unnecessary to prepare and to mix colours. The burdening of the environment is thereby correspondingly reduced.

Figure 15:
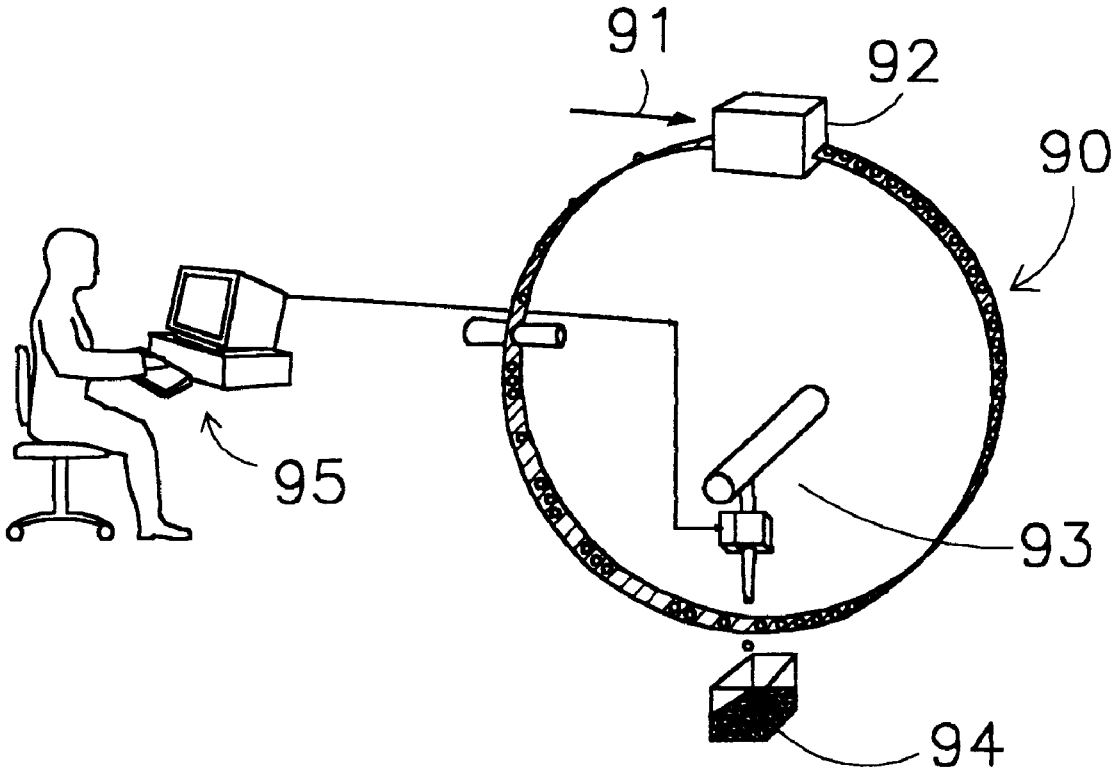
FIG. 15 shows a schematic perspective view of a metering device employing the principles according to the present invention.

FIG. 15 shows an application of the inventive ideas according to the invention in the field of metering of media. A transport device 90 provided with holes is rotated in the direction of arrow 91, and takes up medium in each of its holes from a container 92. The amount of medium in each hole is known. A propelling device 93 selectively removes the medium from predetermined holes of the transport device 90 to a container 94. The propelling device 93 is controlled by a computer 95, in which data relating to the amount of medium to be metered and/or the amount of medium per unit of time is stored and processed. By providing a plurality of units according to FIG. 15, multi-metering devices can be provided. Other advantages of the described metering device are the large metering range, the high speed, no pollution of the medium in the transport device, practically digital operation, fast exchange of transport devices, and possible use in the analytical field. It is observed that also an indirect method of metering similar to the method illustrated in FIGS. 11 and 12 can be used.

While the invention has been described and illustrated in its preferred embodiments, it should be understood that departures may be made therefrom within the scope of the invention, which is not limited to the details disclosed herein.

What is claimed is:

1. A device for applying a medium in liquid, paste or powder form to a substrate for forming a pattern on the substrate, the device comprising:

a transport device for taking the medium and feeding the medium in a distributed way to a delivery zone; and a delivery device positioned in proximity with the delivery zone for transferring the medium from the delivery zone to the substrate, a propelling device with a propellant which is separate from the medium and which is positioned in proximity with the substrate for propelling the medium from the delivery zone, wherein the propelling device is adapted for propelling medium from selectable points of the delivery zone, and a control device in communication with the propelling device for controlling the propelling device and for selecting said points, wherein the propelling device is provided with nozzles arranged over the width of the transport device and valves respectively connected upstream of said nozzles, and wherein the propellant comprises a fluid.

2. The device of claim 1, wherein the propelling device comprises part of the delivery device.

3. The device according to claim 1, wherein the delivery zone comprises a first delivery zone and a second delivery zone, the propelling device being adapted for propelling medium from selectable points of the first delivery zone and the delivery device being adapted for transferring the medium from the second delivery zone to the substrate.

4. The device of claim 1, wherein the medium is discretely transportable to the delivery zone by said transport device.

5. The device of claim 1, said control device controls operation of the propelling device in response to a running speed of the transport device, while taking into account the pattern to be applied.

6. The device of claim 1, wherein the propellant comprises air.

7. The device of claim 1, wherein said propellant comprises gas in a pressure range of between $10^3$ and $10^6$ Pa (0.01 and 10 bar).

8. The device of claim 1, wherein the valves are controlled with a frequency of from 0.1 kHz to 10 kHz so that the propellant delivers the medium to the substrate in the form of gas pulses.

9. The device of claim 1, wherein the nozzles are arranged next to each other in a plurality of rows in a running direction of the transport device.

10. The device of claim 1, wherein the nozzles are arranged next to each other and are offset relative to one another in a plurality of rows in a running direction of the transport device.

11. The device of claim 1, wherein the nozzles are arranged next to each other in a plurality of rows obliquely with respect to a running direction of the transport device.

12. The device of claim 1, wherein the nozzles are arranged free to tilt at an angle of ±90° relative to the transport device.

13. The device of claim 1, wherein the nozzles are displaceable relative to the transport device.

14. The device of claim 13, wherein the displacement of the nozzles is matched to a distance between openings in the transport device.

15. The device of claim 1, wherein the transport device comprises a rotatable transport drum provided with holes.

16. The device of claim 15, wherein the control device comprises an adjustable device for adjusting a position and a rotational speed of the transport drum.

17. The device of claim 16, which comprises a device for holding the position and the rotational speed of the transport drum to a substrate position and speed while taking into account the pattern to be applied to the substrate.

18. The device of claim 1, wherein the transport device comprises a belt, provided with holes guided around at least two rollers.

19. The device of claim 18, wherein the control device comprises a device for adjusting a position and a running speed of the belt.

20. The device of claim 19, wherein the control device comprises a device for matching the position and the running speed of the belt to a position of said substrate and a speed of said substrate while taking into account the pattern to be applied to the substrate.

21. The device of claim 15 or 18, which comprises a device for measuring a position and running speed of the transport device by detecting the holes in the transport device.

22. The device of claim 21, wherein the device for measuring the position and running speed of the transport device comprises an encoder.

23. The device of claim 22, wherein the transport device comprises at least one series of separate encoder holes provided near an edge of the transport device, the encoder holes being arranged to be detected by the encoder.

24. The device of claim 21, wherein the device for measuring the position and running speed of the transport device operates by detecting the holes without contacting the transport device.

25. The device of claim 21, wherein the device for measuring the position and running speed of the transport device comprises an electromagnetic field detecting device for detecting the holes.

26. The device of claim 23, wherein the device for measuring the position and running speed of the transport device operates by detecting the holes without contacting the transport device.

27. The device of claim 23, wherein the device for measuring the position and running speed of the transport device comprises an electromagnetic field detecting device for detecting holes in said drum.

28. The device of claim 1, wherein the transport device and the substrate are movable counter to one another.

29. The device of claim 1, wherein the transport device is positioned at a distance of between 0.1 and 100 mm away from the substrate.

30. The device of claim 1, wherein the distance between the propelling device and the transport device is between 0.01 and 10 mm.

31. The device of claim 1, comprising a container for the medium.

32. The device of claim 31, wherein a container for the medium is provided inside the transport device.

33. The device of claim 31, wherein a container for the medium is provided outside the transport device.

34. The device of claim 31, wherein a container for the medium is provided on both sides of the transport device.

35. The device of claim 31, comprising a delivery roll for transferring the medium from the container to the transport device, and a magnetic or mechanical mating roll lying opposite the delivery roll, behind the transport device relative to the delivery roll.

36. The device of claim 31, comprising at least one applicator device for apportioning the medium withdrawn from the container.

37. The device of claim 36, wherein the applicator device has a blade squeegee and/or a roller squeegee.

38. The device of claim 31, wherein the medium is fed from a container to a feed tube which is arranged in the transport device and runs along the transport device, and is provided with perforations.

39. The device of claim 31, comprising a run-off plate which is provided below the transport device for returning excess medium to the container.

40. The device of claim 1, wherein the transport device comprises an endless belt and two or more deflection rollers over which the belt is movable.

41. The device of claim 40, wherein the substrate is connected to the endless belt by an adhesive bond.

42. The device of claim 1, which comprises an encoder wherein said transport device has medium holes formed therein for receiving and feeding the medium discretely and encoder holes which are detectable by said encoder and which are positioned in a fixed relationship with respect to the medium holes.

43. The device according to claim 13, where in the nozzles are displaceable at right angles to a running direction of the transport device.

44. A device for applying a medium in liquid, paste or powder form to a substrate for forming a pattern on the substrate, the device comprising:

a transport device for taking the medium and feeding it in a distributed way to a delivery zone; and a delivery device positioned in proximity with the delivery zone for transferring the medium from the delivery zone to the substrate, a propelling device with a propellant which is separate from the medium and which is positioned in proximity with the substrate, for propelling the medium from the delivery zone, wherein the propelling device is adapted for propelling medium from selectable points of the delivery zone, and a control device in communication with the propelling device for controlling the propelling device and for selecting said points, wherein the propelling device has a gas feed shaft which runs essentially along the transport device and whose cross-sectional variation is adapted for balancing the hydrostatic pressure drop, in particular being reduced starting from the feed opening until its end.

45. The device of claim 44, wherein the gas feed shaft is routed inside the transport device.

46. A system for applying medium in liquid, powder or paste form to a substrate fed along a predetermined direction, comprising a plurality of devices, which are arranged one behind the other in said predetermined direction, the devices being controllable by a common central processing unit, or each device being controlled separately decentralized, each of said devices comprising:

a device for applying a medium in liquid, paste or powder form to a substrate for forming a pattern on the substrate, said device comprising:

a transport device for taking the medium and feeding the medium in a distributed way to a delivery zone; and a delivery device positioned in proximity with the delivery zone for transferring the medium from the delivery zone to the substrate, a propelling device with a propellant which is separate from the medium and which is positioned in proximity with the substrate for propelling the medium from the delivery zone, wherein the propelling device is adapted of r propelling medium from selectable points of the delivery zone, and a control device in communication with the propelling device for controlling the propelling device and for selecting said points, wherein the propelling device is provided with nozzles arranged over the width of the transport device and valves respectively connected upstream of said nozzles, and wherein the propellant comprises a fluid.

* * * * *